United States Patent [19]

Tarbox

[11] 4,424,627

[45] Jan. 10, 1984

[54] WIRING HARNESS CONSTRUCTION MEANS AND METHOD

[76] Inventor: John W. Tarbox, 13096 Caminito Del Rocio, Del Mar, Calif. 92014

[21] Appl. No.: 170,722

[22] Filed: Aug. 4, 1980

[51] Int. Cl.[3] ..... H01R 43/00

[52] U.S. Cl. ..... 29/857; 29/755; 29/760; 29/872; 40/316; 174/72 A; 174/112; 174/135; 269/40; 269/254 R; 269/903

[58] Field of Search ..... 174/72 A, 112, 135; 29/745, 748, 755, 760, 857, 866, 461, 872, 873; 40/316; 269/40, 254 R, 903; 361/428

[56] References Cited

U.S. PATENT DOCUMENTS 3,949,457 4/1976 Fortsch ..... 174/72 A X
4,300,284 11/1981 Reeder ..... 29/755 X

OTHER PUBLICATIONS

Smith, P. L., "Wire Retainer", *IBM Technical Disclosure Bulletin*, vol. 20, No. 12, May 1978, p. 5141.

*Primary Examiner*—Laramie E. Askin

*Attorney, Agent, or Firm*—Ralph S. Branscomb

[57] ABSTRACT

Means and method are provided for conveniently breaking out wires from a wire bundle in a wiring harness during the fabrication or layout stage, there being a wrapper having two parallel rows of holes punched therein and a specially designed comb having teeth with detent ends which are inserted through the first row of holes in the wrapper. The wire bundle is then passed alongside these teeth with the desired strands being broken out between the teeth, and subsequent to the breakout process the wrapper is folded over the wire bundle and the second row of holes engaged securely over the detent ends of the comb teeth. Both sides of the wrapper are provided with indicia identifying the origin and the destination of wires passing through particular teeth pairs, and a resilient block which temporarily detains the comb and wrapper on the layout board during the fabrication process also utilizes a coded arrangement of upright pins which cooperate with coded holes punched in the wrapper to ensure that only the proper wrapper type is positioned at any of the breakout stations on the layout board.

31 Claims, 16 Drawing Figures

FIG. 1
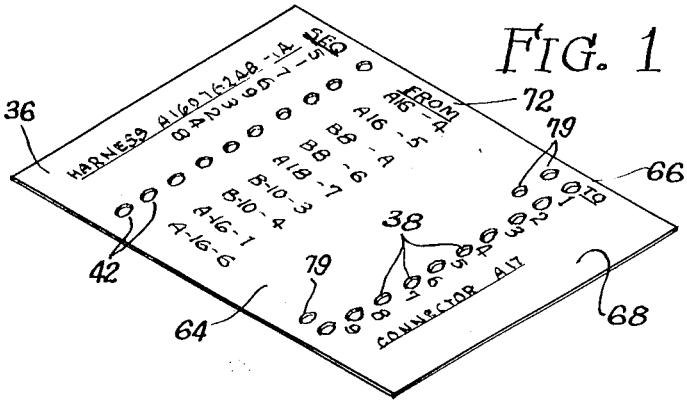
FIG. 2
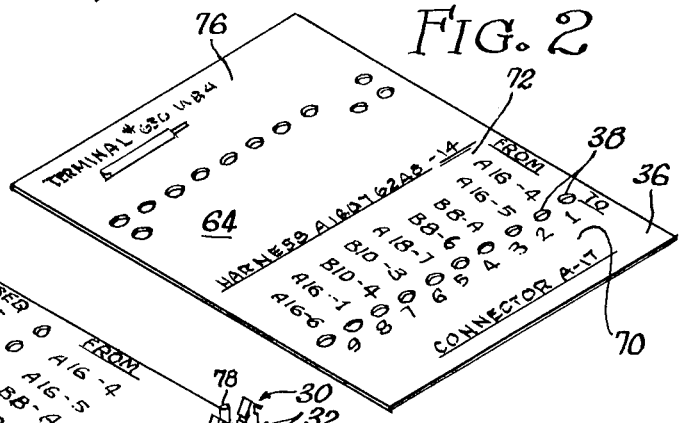
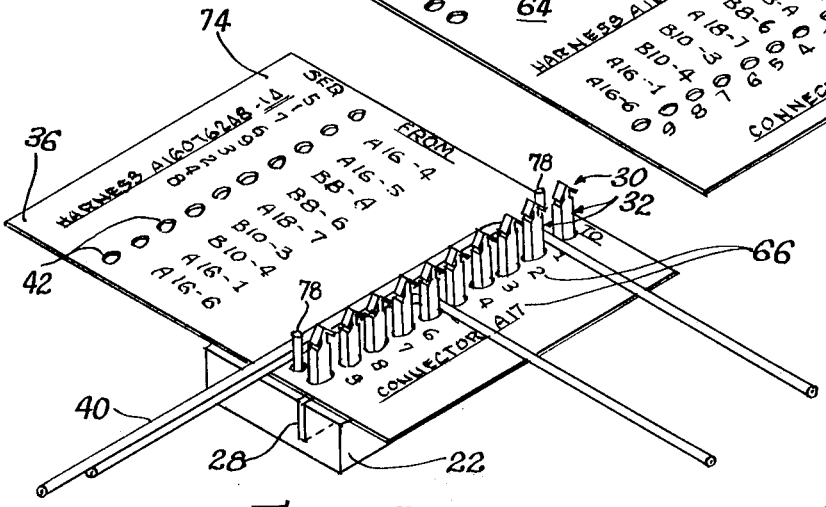
FIG. 3
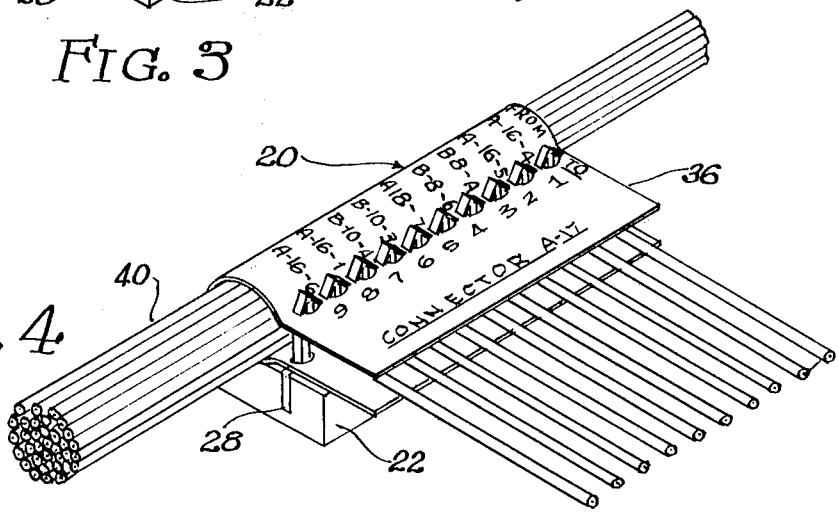
FIG. 4

FIG. 10
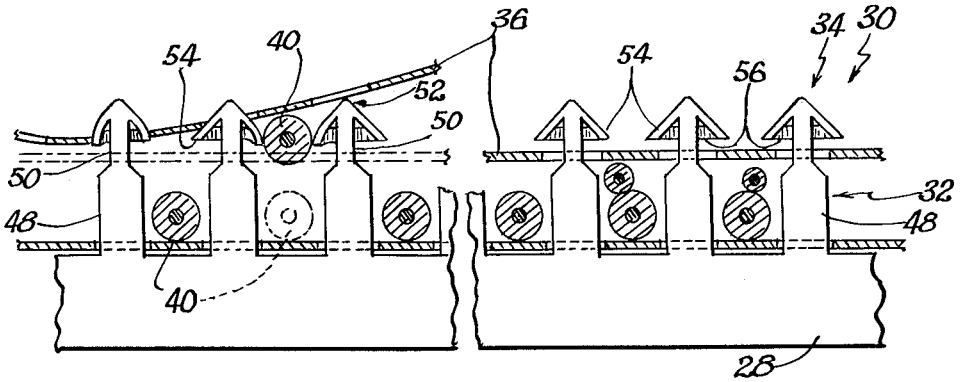
FIG. 11
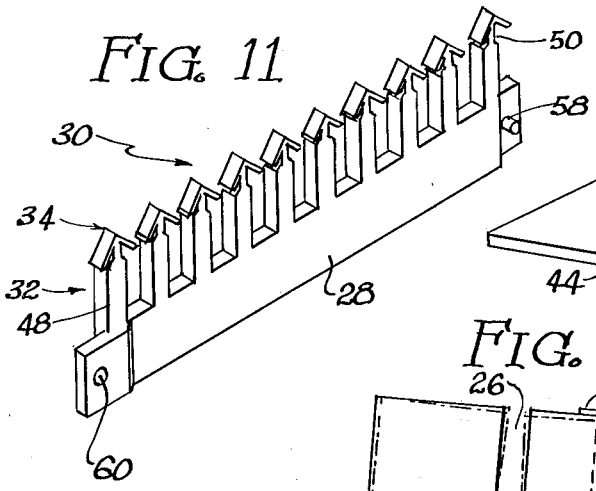
FIG. 13
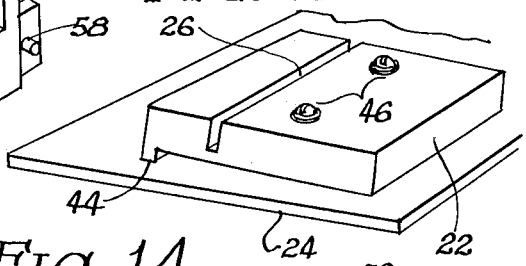
FIG. 14
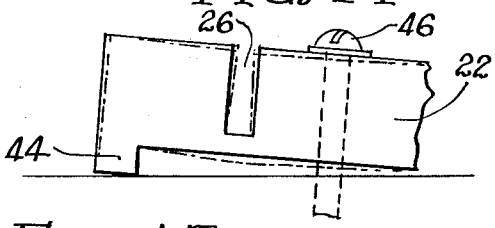
FIG. 15
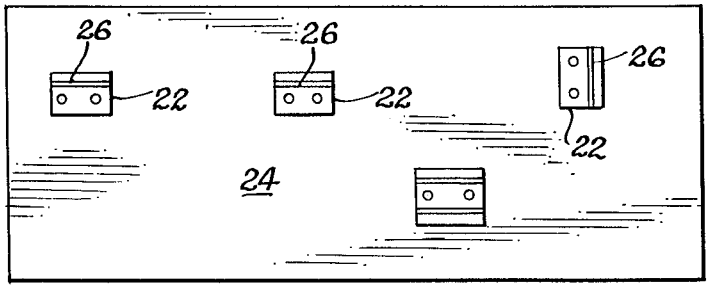
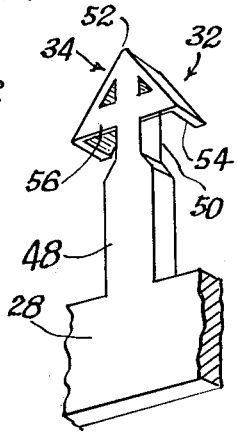
FIG. 16
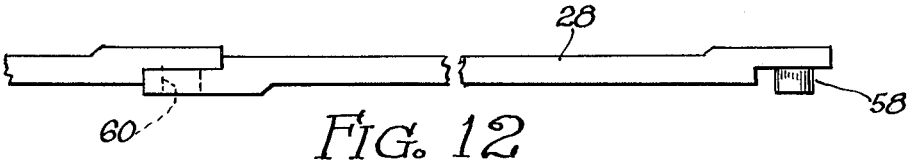
FIG. 12

WIRING HARNESS CONSTRUCTION MEANS AND METHOD

BACKGROUND

The invention is in the field of wire harness making. Wire harnesses are used in electrical appliances, aircraft, boats, automobiles, and electronic equipment where printed circuit boards are not possible. Despite what is obviously an enormous number of harnesses that are needed constantly, harness making technology is not particularly advanced.

Typically, according to present techniques a layout board is used on which nails or pegs are positioned at strategic points where the wires break out, or make a bend. The operator has an instruction sheet or manual informing him or her where each wire goes, and what color it is. The operator bends the wires around the appropriate nails or pegs and then wraps the various bundles and branches of wires with tape, string, or special plastic wrappers which automatically form a closed loop when one end is pulled through an opening in the other end.

Along a typical harness there are positions that are taped or bundled as described above which are called "breakout" points where certain of the wires are diverted from the main bundle to be connected later to one or more electrical connectors. There are some specially designed devices to help order and identify wires at breakout points, one commercially marketed version being similar to its description in U.S. Pat. No. 3,024,301. The marketed version of the device shown in that patent is functionally very similar to the illustrations although the side walls are toothed strips made of plastic. Another device marketed under the trademark "Panduct" utilizes a channel-shaped metallic member with slotted sides through which the breakout wires pass, and a sliding cover which is longitudinally inserted over the open-ended edges of the channel. This device is used primarily with large wires in industrial applications where heavy machinery is being wired.

There is no comprehensive, efficient system utilized for preparing wire harnesses which permits the orderly breaking out of wires at different breakout points and identifies the wires automatically at the breakout point, gives information about the sources and destination of each wire, and also indicates the manner in which the wires must be stripped and the type of connector or terminal that will be attached to the broken out wires without requiring the operator to refer to outside instructions or manuals.

SUMMARY

The present invention fills the above-stated gap in the art by providing a comprehensive means and method of forming wiring harnesses, enabling the breakout points to be dealt with logically and systematically and resulting in a permanently affixed breakout element at each breakout point which identifies source and destination of the broken out wires.

Fabrication of a wiring harness according to the instant means and method starts on a layout board. At the different breakout points on the layout board, a slotted resilient block is screwed down which is preferably specific to that layout station and is keyed to accept wire breakout wrappers with indicia specific to that station.

Once the proper blocks have been fastened to the layout board, a special comb is press-fitted into the slots provided by each block. These combs have upwardly projecting teeth with arrowhead-shaped detent tips, and a pre-perforated wrapper is slipped over these teeth. This wrapper is also provided with the above-mentioned coding in the form of a coded hole pattern which enables them to slip over coded pins projecting upwardly from the mounting block. The wrappers, with the inside up at this point, have information indexed to the spaces between the comb teeth identifying the destination, and preferably the source as well, of the wires to be entrained between the teeth and broken out to a connector.

After the wires have been broken out, the wrapper is folded over the wire bundle and permanently engaged by another row of perforations pressed over the detent ends of the teeth of the comb. The outside of the wrapper also contains indexed rows of indicia identifying sources and destinations of the wires so that a permanent record is made at each junction or breakout point without requiring color coding or manuals. At this point the harness is removed from the layout board, with the combs slipping free of the slotted blocks and becoming a permanent part of the harness along with the wrappers.

BRIEF DESCRIPTION OF THE DRAWINGS

FIG. 1 is a perspective view of the inside surface of a typical wrapper;

FIG. 2 is a perspective view of the outside surface of the wrapper of FIG. 1;

FIG. 3 is a perspective view showing the fabrication of a breakout point;

FIG. 4 is a view similar to FIG. 3 after the breakout has been completed;

FIG. 10 is a diagrammatically illustrated detail showing the engagement of the wrapper over the teeth;

FIG. 11 is an enlarged perspective of the comb;

FIG. 12 illustrates the juncture of two combs as seen from the bottom;

FIG. 13 is an enlarged perspective illustrating the block on the layout board;

FIG. 14 is an illustration of the compression of the slot of the block of FIG. 13;

FIG. 15 illustrates the positioning of the detaining blocks on a layout board;

FIG. 16 illustrates a slightly modified tooth tip wherein the arrowhead barbs are spanned at their lower edge by a flexible web.

DETAILED DESCRIPTION OF THE PREFERRED EMBODIMENT

Figure 5:
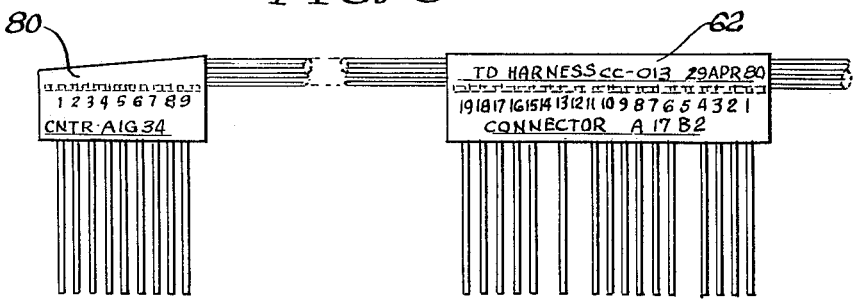
FIG. 5 is a plan view of two different types of completed breakouts.

A typical breakout junction or element 20 which is at the heart of this invention is seen in FIG. 4, and in a preceding stage of completion in FIG. 3. With reference to these two figures, a basic understanding of the simple construction inherent in the design of the instant invention can be had. Basically, a block 22 is properly positioned at a breakout station on a layout board 24 seen in FIG. 15. Passing through the length of the block is a slot 26 which temporarily detains the spine 28 of a comb-like strip, or simply comb, 30. The comb has teeth 32 which will be detailed hereinafter with particular reference to FIG. 10, with detent ends 34.

A wrapper 36 has a first row of pre-perforated holes 38 which are slipped over the teeth into the position shown in FIG. 3. Subsequently, a plurality of wires or strands 40 are drawn along the backside of the teeth and broken out between them as can be seen in both FIGS. 3 and 4. Once all the wires have been properly broken out, the other side of the wrapper is folded over the wires with the second row of holes 42 engaged on the comb teeth 32 to permanently and securely engage both the wire bundle and the breakout wires at the breakout point. Once this has been done at all the breakout stations on the layout broard and any connectors or other devices attached to the broken out ends of the wires, the harness is removed from the layout board by slipping the comb spines 28 out of their slots 26 and the harness is completed, or at least this phase is finished.

Turning now to the details of the invention and referring to FIGS. 13 through 15, as mentioned above, the layout board 24 provides the working surface for the assembly of the harness. On this board it is determined generally where the wires will run and where the breakout points will be, and at the breakout points or breakout stations some device must be installed onto the layout board which will temporarily retain the breakout element of the present invention, including the comb and the wrapper, in position. Clearly a variety of arrangements would accomplish this end quite well and the solution shown here is not intended to be limiting.

In the illustrated embodiment a resilient block 22 is used to temporarily grip the comb. This block preferably has a depending lip 44 which creates a slight void beneath the slot 26, and inasmuch as the block is fabricated of a resilient material and is compressed down against the layout board such as by mounting screws 46, the slot constricts. This constricting action could either be used on a harness-by-harness basis such that each breakout point is individually tightened and loosened for each harness, or more conveniently, it merely provides a way in which the slot can be adjusted if it becomes too loose or too tight over a period of time to make a good friction fit. There could also be pins which pass through the block from the left as seen in FIG. 13 which also pass through holes in the spine of the comb to positively retain it if such action is necessary. However, probably the most convenient approach would be to use a friction fit, adjusted from time to time by the screws 46 to strike a compromise between adequate retaining force and ease of removal of the harness from the board.

Reference will now be made to the comb 30 as best seen in detail in FIGS. 10 through 12. The flat strip or spine 28 of the comb element is deep enough to be inserted all the way into the slot 26. Upstanding from the spine, the teeth 32 comprise a shank portion 48, a narrowed neck 50, an arrowhead-shaped top 52, and a pair of depending barbs 54 which, being part of the arrowhead 52, define the detent function at the tips of the teeth. The teeth, and the rest of the comb, are fabricated of material stiff enough to keep its form but which becomes resilient and easy to deform when it is made thin. The shank and neck of the teeth may move slightly to accommodate an oversized wire or an irregularly positioned wrapper, but basically the wrapper and wires are accommodated by thin, resilient barbs 54 which, as can be seen in FIG. 10, are easily compressed as the wrapper is snapped over them.

It is intended that the wrapper be semi-permanently retained by the detents as shown in FIG. 10, and that the detents not bend upwardly and deform backwards if the wrapper is pulled up after installation. To this end, a small, flexible web 56 can be, and in the preferred embodiment is, part of the arrowhead and spans one side as shown in FIG. 16. It should also be noted that the dimensions of the tooth tips is rather precise in that as the wrapper is snapped over them, there is room adjacent to the neck 50 for the wrapper to reside while the teeth snap back into position.

The ends of the comb element may be provided in different sizes, or may be such that an oversized comb may be fabricated from two or more standard sized elements. This second system is illustrated in FIGS. 11 and 12 where the ends of the comb spine mount on extended tabs a peg and peg hole 58 and 60, respectively. The continuous comb can be constructed as shown in FIG. 12 utilizing this structure. An oversized breakout element utilizing a double comb is shown at 62 in FIGS. 5 and 6.

Turning now to the exact construction and configuration of the wrapper 36, the preferred embodiment is well illustrated in FIGS. 1 through 4. The simplest and cheapest form of wrapper would be reasonably tough paper or plastic stock but conceivably even a pair of hinged panels could be used. The requirements of the wrapper are that it have a central, flexible, or hinged surface 64 which can wrap around the wires as shown in FIG. 4 and projecting sides with the above-described rows of holes 38 and 42. The right side of the wrapper acts as a base member onto which the wires are laid, and the left side acts as a keeper to retain both the wire bundle and the broken out strands in place as shown in FIG. 4.

It is desirable that several types of indicia be presented on the wrapper, some of which are indexed between the rows of holes. Inasmuch as breakout stations are intermediate points for all wires passing therethrough, each wire has an origin and a destination. Although the device does not adapt itself to identify wires which simply pass through from one side to the other, all wires that are broken out can be identified as to their destination by indicia 66 which appears on the inside surface 68 of the wrapper as shown in FIG. 1 and the outside surface as shown at 70 in FIG. 2. In the illustrated embodiment the breakout goes to connector A-17 and the terminal of that connector to which each wire goes is identified by number.

Further information concerning the origin of the wires, identified at 72, is particularly helpful when assembling the breakout junction and is provided on the inside and outside surfaces of the wrapper. Additionally, information as the harness member being made may be included at 74, and on the outside of the wrapper the stock number of the connector to which the breakout wires will lead, together with the length of the wire tips that must be stripped to make the proper connections, may be shown at 76. This is a great benefit to the operator, who can strip and terminate the wires then and there without reference to outside information.

Because all of the information becomes a permanent part of the harness structure, repair and re-wiring is greatly simplified. This information also requires that each of the wrappers be printed specifically for a particular break out. To prevent wrappers from being confused, which would obviously lead to chaos in the harness structure, the wrappers are preferably provided with keyway holes 79 which slip over key pins 78 as shown in FIGS. 1 through 3. This clearly physically prevents the insertion of the wrong wrapper on any of the blocks 22. These pegs have been omitted from FIGS. 13 through 15 for simplification.

There are several ways in which the wrappers can be made, depending at least in part on the number of them which will be needed and how regularly they will be used. First, the holes may be provided either pre-punched in the individual wrapper, or the operator could be provided with a special hole punch tool. The wrappers, independently of the holes, could simply be hand-lettered with the desired indicia if a small number of wrappers is needed.

In the event that a moderate but not tremendous number of a particular wrapper is needed, a sheet of $8\frac{1}{2}$ by 11 paper can be initially printed on both sides with the proper indicia for a series of rows and columns of wrappers. This sheet can be reproduced in any common reprography machine which will copy both sides, and then cut into individual wrappers. A preferred technique would be to reproduce the master sheet on special paper which is already pre-punched with the necessary holes for all the wrappers on that sheet.

In the event a very large number of a particular wrapper is used, they would be provided pre-printed, pre-punched, and pre-cut from the supplier who would use ordinary printing and die cutting techniques.

Figure 6:
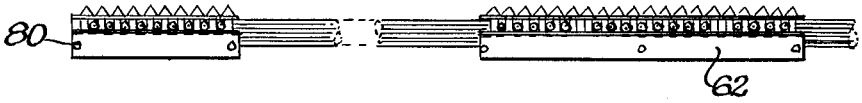
FIG. 6 is an edge view of the breakouts of FIG. 5.

Several different types of breakouts are shown in FIGS. 5 through 9. The double comb of FIGS. 5 and 6 has already been mentioned, and a terminal breakout 80, which orders the last wires to be ordered in the wire bundle, is also shown in FIGS. 5 and 6.

Figure 7:
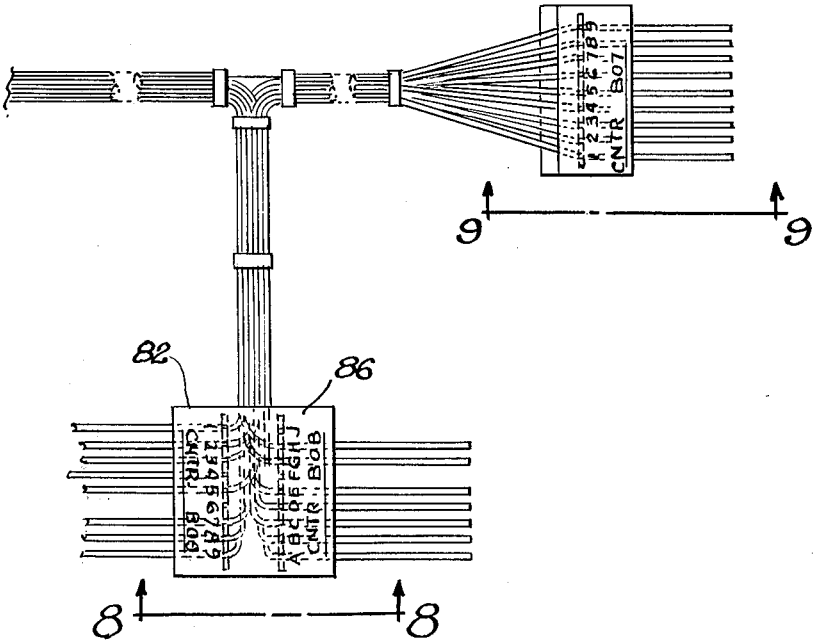
FIG. 7 is a plan view of an additional pair of breakout styles.
Figure 8:
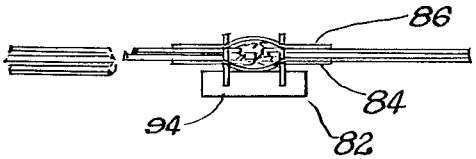
FIG. 8 is a view taken along Line 8—8 of FIG. 7.
Figure 9:
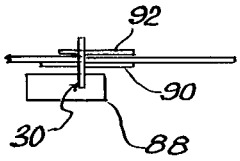
FIG. 9 is a view taken along Line 9—9 of FIG. 7.

There are at least two instances in which a pair of the wrappers would be used at a single breakout. As shown in FIGS. 7 and 8, a bi-lateral breakout 82 uses one wrapper for the base wrapper at 84 and a second wrapper 86 as the keeper.

In breakout 88, the incoming wires do not run parallel to the comb and would conflict where the wrapper fold would ordinarily be. Therefore, bottom and top, base and keeper wrappers means 90 and 92 are used. Note that in the sandwich shown at 82, either a dual block or a special block 94 is needed, as two combs are used, whereas the breakout at 88 uses the standard block 22 and a single comb.

It is intended that the harness-forming means and method described, illustrated and claimed herein will be used in conjunction with already developed automatic wire threading and feeding machinery which is computer controlled. This machinery is adapted to easily wire connectors of the insulation displacement type which are becoming increasingly popular, and these connectors might also appear on the layout board 24.

Thus as disclosed and claimed, the method and structure shown herein represents the most advanced wire bundling and breakout procedures yet to surface in the harness-making industry.

I claim:

1. Structure for retaining, identifying and arraying wire strands in electrical harnesses and the like, said structure comprising:

(a) an elongated comb-like strip having a row of teeth on at least one longitudinal edge thereof with elongated slots defined by and between said teeth and extending transversely of the strip;

(b) said teeth having substantially inflexible shank portions and opposing detent portions adjacent to the ends of said teeth, and said detent portions being at least slightly flexible and capable of accepting and capturing at least one wire strand in each of said slots by resilient deflection in the general longitudinal plane only of said comb-like strip without substantial deflection of said shank portions;

(c) a keeper securable by said detent portions on said teeth to retain the wire strands;

(d) the detent portion of each of said teeth defining an arrowhead with a pair of resilient down-sloped barbs to engage said keeper; and, (e) the barbs of each of said barb pairs being connected along at least one edge by a flexible web.

2. Structure for retaining, identifying and arraying wire strands in electrical harnesses and the like, said structure comprising:

(a) an elongated comb-like strip having a row of teeth on at least one longitudinal edge thereof with elongated slots defined by and between said teeth and extending transversely of the strip;

(b) said teeth having substantially inflexible shank portions and opposing detent portions adjacent to the ends of said teeth, and said detent portions being at least slightly flexible and capable of accepting and capturing at least one wire strand in each of said slots by resilient deflection in the general longitudinal plane only of said comb-like strip without substantial deflection of said shank portions;

(c) a keeper securable by said detent portions on said teeth to retain the wire strands;

(d) the detent portion of each of said teeth defining an arrowhead with a pair of resilient down-sloped barbs to engage said keeper; and, (e) said keeper being planar and having a plurality of holes to snap over said arrowheads, and each of said teeth defining a narrowed neck above said shank terminating in said arrowhead detent, said neck being of length adequate to leave a space equal to at least the thickness of said keeper between said shank and said barbs when the latter are fully deformed against said neck.

3. Structure for retaining, identifying and arraying wire strands in electrical harnesses and the like, said structure comprising:

(a) an elongated comb-like strip having a row of teeth on at least one longitudinal edge thereof with elongated slots defined by and between said teeth and extending transversely of the strip;

(b) said teeth having substantially inflexible shank portions and opposing detent portions adjacent to the ends of said teeth, and said detent portions being at least slightly flexible and capable of accepting and capturing at least one wire strand in each of said slots by resilient deflection in the general longitudinal plane only of said comb-like strip without substantial deflection of said shank portions;

(c) a keeper securable by said detent portions on said teeth to retain the wire strands; and, (d) said keeper defining a wrapper having dual rows of holes securable on said teeth to define a fold in said wrapper between said rows of holes to capture a main bundle of incoming wire strands from which selected wire strands can be diverted through said slots.

4. Structure according to claim 3 and including a releasable gripper block having a slot for gripping said strip, and said block having means to mount same on a surface for convenient harness fabrication.

5. Structure according to claim 4 wherein said gripper block incorporates keying means keyed to a specific keeper type such that in the event different keepers are used in a single harness, correct keeper and block combinations will be insured.

6. Structure according to claim 5 wherein said keying means comprises upright pins coded by position and cooperating with keyed holes in coded keyed hole patterns in said keepers.

7. Structure according to claim 3 and including a base wrapper having dual rows of holes aligned with the holes in said keeper wrapper and further including a second comb-like strip to form a comb strip pair with the first mentioned comb-like strip, and said wrappers being overlaid with the respective hole rows aligned such that said wrappers can be used for sandwiching a bundle of wire strands therebetween with said bundle being retained on both sides by said strip pair the teeth of which engage the respective holes in both said wrappers for diverting selected wire strands from said bundle through the slots therebetween to define a bi-directional breakout.

8. Structure according to claim 3 wherein said wrapper has an inside surface and an outside surface, and at least one of said surfaces incorporates indicia aligned with the spaces between the holes of at least one of said rows identifying the destination of the respective wire strands broken out through said teeth.

9. Structure according to claim 3 wherein said wrapper has an inside surface and an outside surface, and at least one of said surfaces incorporates indicia aligned with the spaces between the holes of at least one of said rows identifying the origin of the respective wire strands broken out through said teeth.

10. Structure according to claim 8 or 9 wherein the outside surface of said wrapper incorporates indicia identifying the destination of terminal wires broken out therefrom.

11. Structure according to claim 3 wherein said strip has a connection at each end adapted to snap onto an identical strip whereby a strip of indefinite effective length can be created.

12. Structure according to claim 11 wherein said strip has at each end a tab offset from the vertical centerplane thereof in mutually opposite directions and one of said tabs has a peg and the other of said tabs has a hole engageable on said peg to define a connection between two identical strips.

13. Structure according to claim 3 wherein the detent portion of each of said teeth defines an arrowhead with a pair of resilient down-sloped barbs to engage said keeper.

14. Structure for retaining, identifying and breaking out individual strands of wire from a bundle comprising:

(a) a wrapper having a back flap, a front flap, and a central connector portion hingedly joining said flaps;

(b) means connecting said flaps at multiple spots separated by intervals along the outside edges thereof opposite the central connector portion to define sequential breakout openings between said flaps at said spaced intervals; and (c) indicia on said wrapper indexed with said spaced intervals providing routing information correlated to the particular wire strands to be broken out through the respective openings to reduce the dependency of a harnessmaker on outside instruction materials.

15. Structure according to claim 14 wherein said front flap has a front surface displaying indicia indexed to said spaced intervals identifying the destinations of wire strands broken out through said openings after said flaps have been connected.

16. Structure according to claim 14 wherein said spots comprise holes and said means connecting said flaps comprises a strip having spaced teeth with detent ends engaged through said holes.

17. Structure according to claim 14 and including a layout board having a plurality of breakout stations and defining a keying means at each of said layout stations, and said wrapper is one of a plurality of wrappers each defining a keyway coded to a particular one of said keying means to ensure correct assignment of said wrapper on said board.

18. Structure according to claim 17 wherein said keyways each comprise a coded hole pattern and said keying means comprises pins spaced and positioned to engage in a selected one of said hole patterns.

19. A layout board apparatus for temporarily retaining, identifying and arraying strands in electrical harnesses or the like which have a strand bundle with at least one breakout point therealong from which individual strands from said bundle are ordered and diverted from the strand bundle to a connector or the like, said layout board comprising:

(a) a layout panel;

(b) at least one breakout station defined on said panel;

(c) a breakout element for each of said breakout stations, each such element being adapted to independently engage and contain a strand bundle at a breakout point and order and divert individual strands from the bundle; and (d) said at least one station each having means to temporarily and releasibly engage a breakout element.

20. Structure according to claim 19 wherein said breakout station includes a block having a slot therein and said breakout element defines a strip removably seatable in said slot.

21. Structure according to claim 20 wherein said slot is open in the direction away from said panel and said block defines a void beneath said slot and above said panel, and including means for adjustably compressing said block against said panel to collapse said slot to grip a strip seated therein.

22. Structure according to claim 19 wherein said panel defines a plurality of breakout stations and including a plurality of different types of breakout elements, and each of said breakout stations defines a key and each of said breakout elements defines a keyway cooperative with one of said keys whereof a selected breakout element will be engaged only by the keyed breakout station related therefor.

23. Structure according to claim 22 wherein the keyway of said breakout element defines a coded hole pattern and said keys comprise upright pins in a coded arrangement.

24. Structure according to claim 19 wherein said breakout element breaks out strands in an ordered row and displays indicia indexed to the strands in said row identifying their source and their destination.

25. A method of laying out a wiring harness having a plurality of strand breakout points along a bundle of strands using a layout board with a plurality of breakout stations and releasible engagement means at each of said layout stations and a plurality of comb-like strips having upright teeth with detent tips engagable by said engagement means, said method including the following steps:

(a) engaging at least one of said comb-like strips in each of those of said engagement means which correspond to a breakout point of a harness being made;

(b) on each of said strips engaging a first edge of a flexible wrapper over said teeth and pressing down until said teeth project thru said wrapper;

(c) drawing sequential strands across said board adjacent each respective one of said comb-like strips and breaking at least one of said strands laterally out through sequential pairs of teeth of each of said comb-like strips; and, (d) folding said wrapper over said strand bundle and engaging a second edge of said wrapper opposite said first edge over said teeth to be detained by said detent tips.

26. A method according to claim 25 and including the further step of marking the surface of said wrapper adjacent said teeth to identity the source and destination of strands passing therethrough.

27. A method according to claim 26 wherein said further step includes creating as a master a sheet of paper having multiple wrappers thereon in sequential rows and columns using reprography techniques to reproduce said wrappers on reproduction sheets having pre-punched hole rows corresponding to the positioning of said teeth in said wrappers after step (d), and then dividing said reproductive sheet into individual wrappers.

28. A method according to claim 25 wherein said wrappers have rows of pre-punched holes corresponding to the spacing of said teeth and steps (b) and (d) comprise pressing said teeth through said holes.

29. A method according to claim 28 wherein said wrappers are provided with a pre-printed code indexed between said holes identifying the destination of strands broken out through said teeth.

30. A method according to claim 29 wherein said wrappers include indicia providing instructions on the stages needed to terminate strands broken out through said teeth and further including the step of installing a terminal on the ends of strands so broken out according to said instructions.

31. A method according to claim 25 and including the further step of removing said comb-like strips from said breakout stations and removing the resulting harness, including said strips, from the layout board.

* * * * *